US009901758B2

(12) United States Patent
Furuichi et al.

(10) Patent No.: US 9,901,758 B2
(45) Date of Patent: Feb. 27, 2018

(54) RESPIRATORY PROTECTION DEVICE

(71) Applicant: KOKEN LTD., Chiyoda-ku, Tokyo (JP)

(72) Inventors: Ryohei Furuichi, Tokyo (JP); Yu Ishikawa, Tokyo (JP)

(73) Assignee: KOKEN LTD., Tokyo (JP)

( * ) Notice: Subject to any disclaimer, the term of this patent is extended or adjusted under 35 U.S.C. 154(b) by 564 days.

(21) Appl. No.: 14/380,582

(22) PCT Filed: Feb. 21, 2013

(86) PCT No.: PCT/JP2013/054410
§ 371 (c)(1),
(2) Date: Aug. 22, 2014

(87) PCT Pub. No.: WO2013/025656
PCT Pub. Date: Aug. 29, 2013

(65) Prior Publication Data

US 2015/0034080 A1 Feb. 5, 2015

(30) Foreign Application Priority Data

Feb. 23, 2012 (JP) ..... 2012-038048

(51) Int. Cl.
*A62B 9/02* (2006.01)
*A62B 18/02* (2006.01)
(Continued)

(52) U.S. Cl.
CPC ..... *A62B 18/08* (2013.01); *A62B 9/006* (2013.01); *A62B 9/02* (2013.01); *A62B 18/02* (2013.01);
(Continued)

(58) Field of Classification Search
CPC ..... H04R 1/028; H04R 1/083; H04R 3/00; H04R 1/08; A62B 18/08; A62B 18/02;
(Continued)

(56) References Cited

U.S. PATENT DOCUMENTS 4,799,263 A * 1/1989 Banziger ..... B63C 11/26 128/201.19
5,060,308 A * 10/1991 Bieback ..... H04B 10/00 128/201.19
(Continued)

FOREIGN PATENT DOCUMENTS

JP 58-177151 U 11/1983
JP 2003-117013 A 4/2003
(Continued)

OTHER PUBLICATIONS

Extended European Search Report dated Oct. 7, 2015, corresponding to European Patent Application No. 13751763.7.
(Continued)

*Primary Examiner* — Kathryn E Ditmer
(74) *Attorney, Agent, or Firm* — Hauptman Ham, LLP

(57) ABSTRACT

A respiratory protection device is provided that allows the wearers of a facepiece to smoothly have a conversation with each other. A respiratory protection device includes a facepiece. The protection device also includes a voice amplifier that includes a microphone and a speaker therein, a detection unit that directly or indirectly detects the inner pressure of the facepiece, a power source unit, and a control unit. The control unit controls so as to place the voice amplifier in an operational state or a non-operational state, based on a result of comparison of information from the detection unit with a determination reference in the control unit.

16 Claims, 12 Drawing Sheets

(51) Int. Cl.

| | |
|---|---|
| ***A62B 18/08*** | (2006.01) |
| ***H04R 1/02*** | (2006.01) |
| ***H04R 1/08*** | (2006.01) |
| ***H04R 3/00*** | (2006.01) |
| ***A62B 9/00*** | (2006.01) |

(52) U.S. Cl.
CPC ..... *H04R 1/028* (2013.01); *H04R 1/083* (2013.01); *H04R 3/00* (2013.01)

(58) Field of Classification Search
CPC .... A62B 7/00; A62B 7/12; A62B 7/14; A62B 9/00; A62B 9/02; A62B 9/006; A62B 17/00; A62B 17/003; A62B 17/006; A62B 17/008; A62B 17/04; A62B 18/00; A62B 18/006; A62B 18/025; A62B 18/04; A62B 18/045; A62B 18/10
USPC ..... 128/201.19
See application file for complete search history.

(56) References Cited

U.S. PATENT DOCUMENTS

| | | | | |
|---|---|---|---|---|
| 5,159,641 | A * | 10/1992 | Sopko | H04R 3/00 128/201.19 |
| 5,307,793 | A | 5/1994 | Sinclair et al. | |
| 5,318,018 | A * | 6/1994 | Puma | A62B 17/008 128/202.11 |
| 5,829,431 | A * | 11/1998 | Hannah | A62B 18/08 128/201.19 |
| 2003/0047183 | A1 | 3/2003 | Kiefer et al. | |
| 2005/0022819 | A1 | 2/2005 | Capon et al. | |
| 2007/0283952 | A1* | 12/2007 | Wilbur | A62B 7/04 128/201.19 |
| 2010/0224190 | A1* | 9/2010 | Tilley | A62B 18/006 128/204.21 |
| 2010/0322442 | A1 | 12/2010 | Namm | |
| 2012/0180788 | A1* | 7/2012 | Imran | H04R 1/44 128/201.19 |

FOREIGN PATENT DOCUMENTS

| | | | |
|---|---|---|---|
| JP | 2004-535259 | A | 11/2004 |
| JP | 2005-514963 | A | 5/2005 |
| JP | 2009-089794 | A | 4/2009 |

OTHER PUBLICATIONS

International Search Report dated May 14, 2013 in International Application No. PCT/JP2013/054410 filed Feb. 21, 2013.

* cited by examiner

RESPIRATORY PROTECTION DEVICE

RELATED APPLICATIONS

The present application is a National Phase of International Application Number PCT/JP2013/054410, filed Feb. 21, 2013, which claims priority to Japanese Application Number 2012-038048, filed Feb. 23, 2012.

TECHNICAL FIELD

The present invention relates to a respiratory protection device and more particularly relates to a respiratory protection device with a loudspeaker.

BACKGROUND

In the working environment containing dust and poisonous gases, there have been conventionally known respiratory protection devices worn by an operator in order to prevent damage caused by the dust and the poisonous gases in the environment, and respiratory protection devices including a speaking diaphragm or a loudspeaker.

For example, a respiratory protection device disclosed by Japanese Unexamined Patent Application Publication No. 2003-117013A (Patent Literature 1) includes an electric fan unit on the bilateral side portion of a facepiece, and a speaking diaphragm is attached to the central portion in the width direction of the facepiece.

Also, a mask disclosed by Japanese Unexamined Utility Model Application Publication No. 1983-177151A (Patent Literature 2) includes a loudspeaker that facilitates conversation between operators. The loudspeaker includes a microphone, a speaker, a battery, and the others.

CITATION LIST

Patent Literature

{PTL 1} JP 2003-117013A
{PTL 2} JP 1983-177151A

SUMMARY

Technical Problem

Regarding the respiratory protection device that covers the nostrils and the mouth of a facepiece wearer by means of the facepiece, there is a problem in that it is difficult to transmit the voice of the wearer to nearby persons, which makes it impossible for the wearer to have a conversation with the nearby persons. Although the speaking diaphragm attached to the conventional respiratory protection device is a means that solves the above-mentioned problem, there is a problem in that the magnitude of the voice uttered by the wearer is damped, which is not suitable for use in a high noise environment. Although the mask equipped with the loudspeaker according to conventional technologies can solve the defects of the speaking diaphragm, not only the voice of the wear but also sound generated along with respiration of the wearer is amplified, which prevents the effective conversation between the wearers of the facepiece.

The present invention has been achieved in view of the above circumstances to solve the problems, and it is an object of the present invention to provide a novel respiratory protection device in which a loudspeaker attached to the respiratory protection device can be effectively used.

Solution to Problem

In order to solve this problem, the present invention relates to the respiratory protection device that includes a facepiece, which can cover at least nostrils and a mouth of a wearer, and that allows air for inhalation to make an entry into an inside of the facepiece.

The characteristic features of the present invention includes a voice amplifier configured to include at least a microphone and a speaker, a detection unit configured to detect change in inner pressure of the facepiece in a worn condition by any of direct and indirect methods, a power source unit, and a control unit configured to be electrically connected to the voice amplifier and the detection unit and control so as to place the detection unit into an operational state and a non-operational state and configured to control so as to place the voice amplifier into an operational state and a non-operational state based on information from the detection unit, wherein the control unit, which makes control of the detection unit in the operational state, controls the voice amplifier based on a result of comparison of the information from the detection unit with a determination reference in the control unit.

According to one aspect of the present invention, the control unit compares the determination reference with the information transmitted from the detection unit for each predetermined time and controls so as to place the voice amplifier in any of the operational state and the non-operational state, and a first control state of when the control unit compares first information, which is one piece of the information, with the determination reference and controls so as to place the voice amplifier in any of the operational state and the non-operational state is continued until second information that is new information is transmitted after a lapse of the predetermined time, and the first control state is released as a consequence of the transmission of the second information.

According to one aspect of the present invention, the control unit compares the determination reference with the information transmitted from the detection unit for each predetermined time and controls so as to place the voice amplifier in any of the operational state and the non-operational state, and when the control unit compares first information, which is one piece of the information, with the determination reference and controls so as to place the voice amplifier in the operational state, even when the control unit compares the determination reference with second information that is new information transmitted after a lapse of the predetermined time and determines that the voice amplifier is controlled in the non-operational state, the operational state is continued for a constant period of time.

According to one aspect of the present invention, when the control unit compares the determination reference with the first information that is one piece of the information and transmitted from the detection unit for each predetermined time and controls the voice amplifier in the operational state, the constant period of time during which the operational state is continued is 0.01 to 2 seconds.

According to one aspect of the present invention, the control unit is such that intervals of the information transmitted from the detection unit to the control unit for each predetermined time is 0.01 to 100 msec.

According to one aspect of the present invention, the detection unit configured to detect the change in the inner pressure of the facepiece by the indirect method detects presence or absence of variation and variation amount in response to the change in inner pressure of any of an open/close valve and a diaphragm attached to the facepiece.

According to one aspect of the present invention, the variation amount is variation amount of any of light, ultrasonic waves, magnetism, capacitance, electric currents, voltages, and electric resistance.

According to one aspect of the present invention, the presence or absence of the variation is detected as presence or absence of opening or closing of the open/close valve and as presence or absence of variation of the diaphragm.

According to one aspect of the present invention, the detection unit is made up of any of an optical sensor, a magnetic sensor, an ultrasonic sensor, a capacitance sensor, a current sensor, an instrument to measure voltages, and an instrument to measure electric resistance.

According to one aspect of the present invention, the determination reference is provided to determine any of an opening degree of the open/close valve, presence or absence of contact with a valve seat of the open/close valve, the variation amount of the diaphragm, and presence or absence of contact of the diaphragm with a contact point member with respect to the diaphragm, and wherein in any of when the opening degree is equal to or higher than an opening degree set as the determination reference, when the open/close valve and the valve seat are not in a contact state, when the variation amount of the diaphragm is equal to or higher than variation amount set as the determination reference, and when the diaphragm and the contact point member are not in a contact state, the control unit controls so as to place the voice amplifier in the operational state.

According to one aspect of the present invention, the detection unit configured to detect the change in the inner pressure of the facepiece by the direct method is a pressure sensor configured to detect the inner pressure of the facepiece.

According to one aspect of the present invention, the protection device is a respiratory protection device with an electric fan that includes a blower unit inclusive of at least a fan and a motor, thereby supplying the air for inhalation to the inner side of the facepiece.

According to one aspect of the present invention, the protection device is such that the power source unit is also used to operate the blower unit.

According to one aspect of the present invention, any of the optical sensor, the magnetic sensor, the ultrasonic sensor, the capacitance sensor, the current sensor, the instrument to measure voltages, the instrument to measure electric resistance, and the pressure sensor is used in order to operate the blower unit.

According to another aspect of the present invention, the control unit includes a second determination reference and controls the blower unit based on a result of comparison of the information from the detection unit with the second determination reference.

According to another aspect of the present invention, the protection device is any of a dust mask and a gas mask in which the air for inhalation enters the inner side of the facepiece by power of lungs of the wearer who wears the protection device.

According to another aspect of the present invention, the protection device is any of a breathing apparatus and an air-supplied respirator in which the air for inhalation enters the inner side of the facepiece from an air supply, which is a separate body with respect to the facepiece.

Advantageous Effects of Invention

The respiratory protection device according to the present invention includes a detection unit configured to detect change in the inner pressure of the facepiece in a worn condition by any of direct and indirect methods and controls so as to place the voice amplifier into an operational state and a non-operational state, based on a result of comparison of information from the detection unit with a determination reference in the control unit. Accordingly, for example, a determination reference is set such that the voice amplifier is placed in a non-operational state at least for part of a time period during which the wearer is in an inhalation movement, so that a problem can be solved wherein a voice generated in an inhalation movement is amplified by the voice amplifier, which causes the impediment to smooth conversation between the wearers who wear the facepiece.

DESCRIPTION OF EMBODIMENTS

Hereinafter, a respiratory protection device according to the present invention will be described in detail by referring to the attached drawings.

Figure 1:
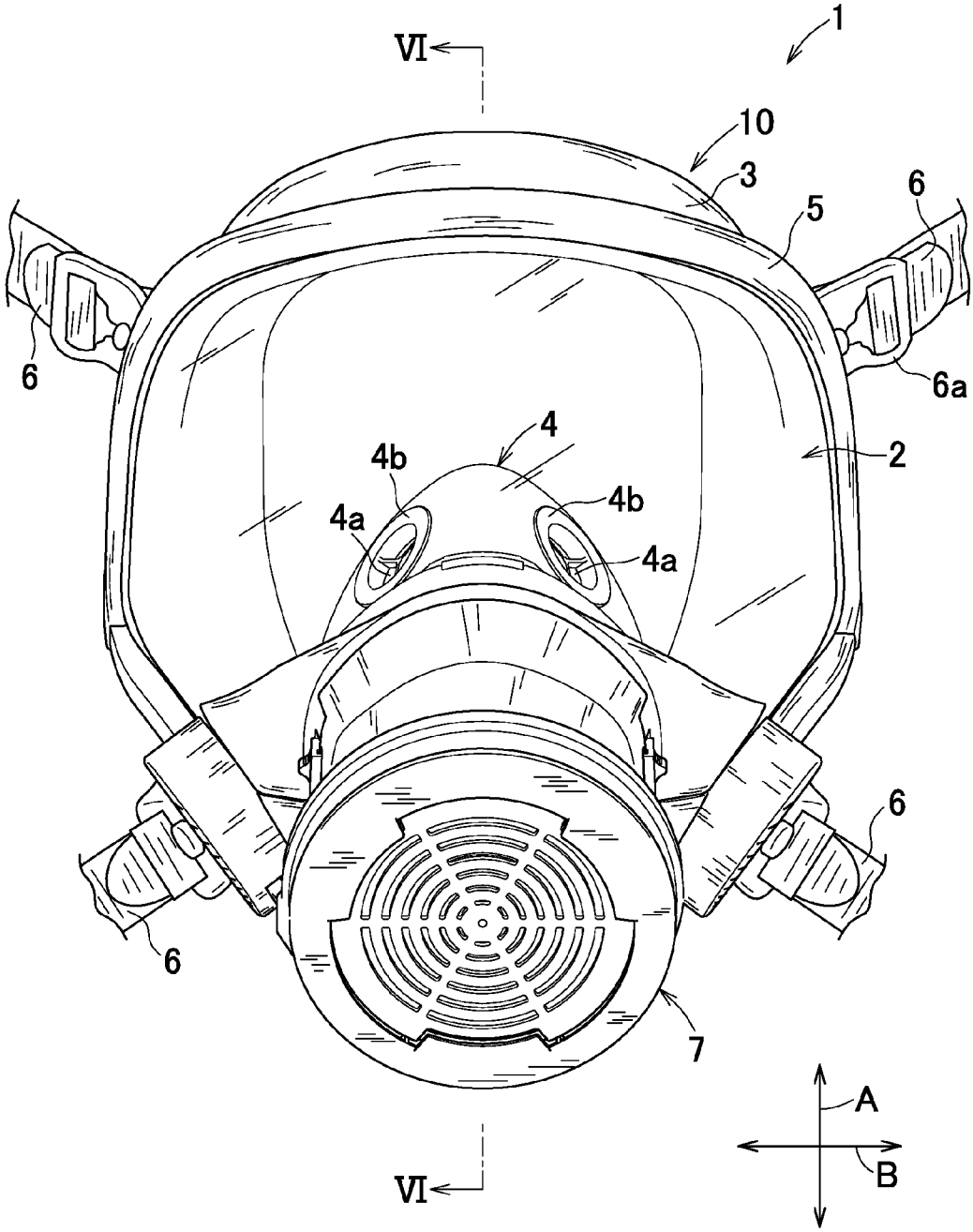
FIG. 1 is a front view of a respiratory protection device (mask).

FIG. 1 is a front view of a full face mask 1 illustrated as one example of a respiratory protection device. The mask 1 is a sort of mask prescribed in JIS T 8157 and also referred to as a respiratory protection device with an electric fan or referred to as a blower mask. The mask 1 includes a facepiece 10 that can cover at least the nostrils and the mouth of a wearer (not illustrated), and a detachable filtering unit 7 is set in the facepiece 10. The facepiece 10 includes an eyepiece 2 formed of transparent, hard synthetic resin such as a polycarbonate resin and the like or formed of inorganic glass, a face contact pad 3 formed of a flexible, elastic material such as urethane rubber and attached via a frame 5 formed of a hard synthetic resin with respect to the peripheral edge portion of the eyepiece 2, a bulkhead, that is, a nose cup 4 formed of a flexible, elastic material, through which the eyepiece 2 can be visible, and others. In the face contact pad 3, adjustable straps that fasten the head of a mask wearer (not illustrated) are attached by the intermediary of buckles 6*a*. The nose cup 4 is positioned on the inner side of the eyepiece 2 and formed so as to cover the nostrils and the mouth of a wearer and includes a symmetrical pair of first check valves 4*a* for inhalation and ring-shaped members 4*b* by which the first check valves 4*a* are mounted. A two-headed arrow A illustrated in the drawing represents the vertical direction of the mask 1, and a two-headed arrow B represents the crosswise direction of the mask 1. The crosswise direction B also represents the right-and-left direction of the wearer of the mask 1. It is noted that the right-and-left direction means the right-and-left direction for the wearer.

Figure 2:
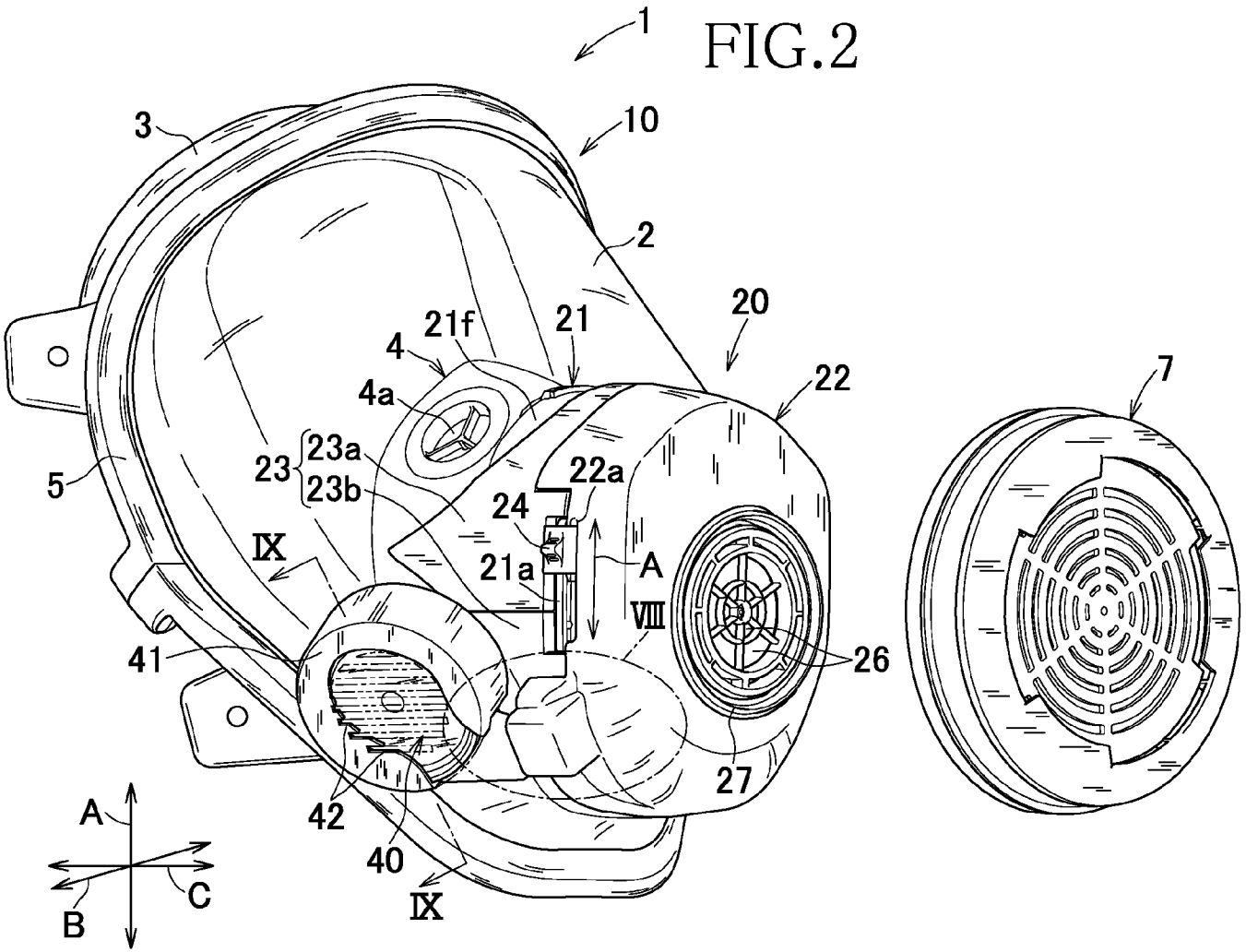
FIG. 2 is a perspective view of a mask whose right-side portion is partially broken.

FIG. 2 is a partial broken perspective view of the mask 1 in which the filtering unit 7 is in a separate state, and the illustration of the adjustable straps 6 is omitted, and the right-side surface portion of the mask 1 is represented, and a two-headed arrow C represents the front-and-back direction of the mask 1. In the eyepiece 2 of the facepiece 10, an inhalation and exhalation unit 20 is detachably incorporated at the central portion of the crosswise direction B, and a voice amplifier is disposed on the right-side surface portion. The voice amplifier is provided in the form of a loudspeaker unit 40 in which a microphone and a speaker described later are integrated, for the purpose of facilitating the detachment from the mask 1. The loudspeaker unit 40 is covered with a cover 41 that is detachable from the eyepiece 2. The cover 41 is provided with a many of vent holes so as to carry the voice well from the loudspeaker unit 40 to the outside of the mask 1.

The inhalation and exhalation unit 20 in FIG. 2 includes a first inner side member 21 fitted with a through hole 2*a* (see FIG. 6) formed at the central portion of the crosswise direction B of the eyepiece 2, from the inner side of the eyepiece 2, wherein the most part of the first inner side member 21 is positioned on the inner side of the eyepiece 2, and first and second outer side members 22 and 23, wherein the whole is positioned on the outer side of the eyepiece 2. A slide piece 24 is slid upward that is slidably mounted in the vertical direction A on a rail portion 21*a* disposed on the outer side of the eyepiece 2 through the opening 2*a* in the first inner side member 21, whereby slide piece 24 is inserted in a slide groove 22*a* formed in the first outer side member 22, and the first inner side member 21 and the first outer side member 22 are integrated by the intermediary of the slide piece 24. It should be noted here that, in FIG. 2, when the slide piece 24 is slid downward, the slide piece 24 leaves the slide groove 22*a*, and on the right-side surface portion of the facepiece 10, the first inner side member 21 and the first outer side member 22 are released from the state where both are integrated into one and brought into a separable state. The second outer side member 23 is divided into an upper member 23*a* and a lower member 23*b*, and when both the members 23*a* and 23*b* are fitted with each other in the vertical direction A, the peripheral edge portion 21*f* (see FIG. 6) of the first inner side member 21 is in close contact with the inner surface of the eyepiece 2, and the first inner side member 21 is prevented from falling out of the through hole 2*a* of the eyepiece 2 toward the rear direction. On the front surface portion of the inhalation and exhalation unit 20, formed are a plurality of vent holes 26 for inhalation and a screw portion 27 by which the filtering unit 7 is demountable.

Figure 3:
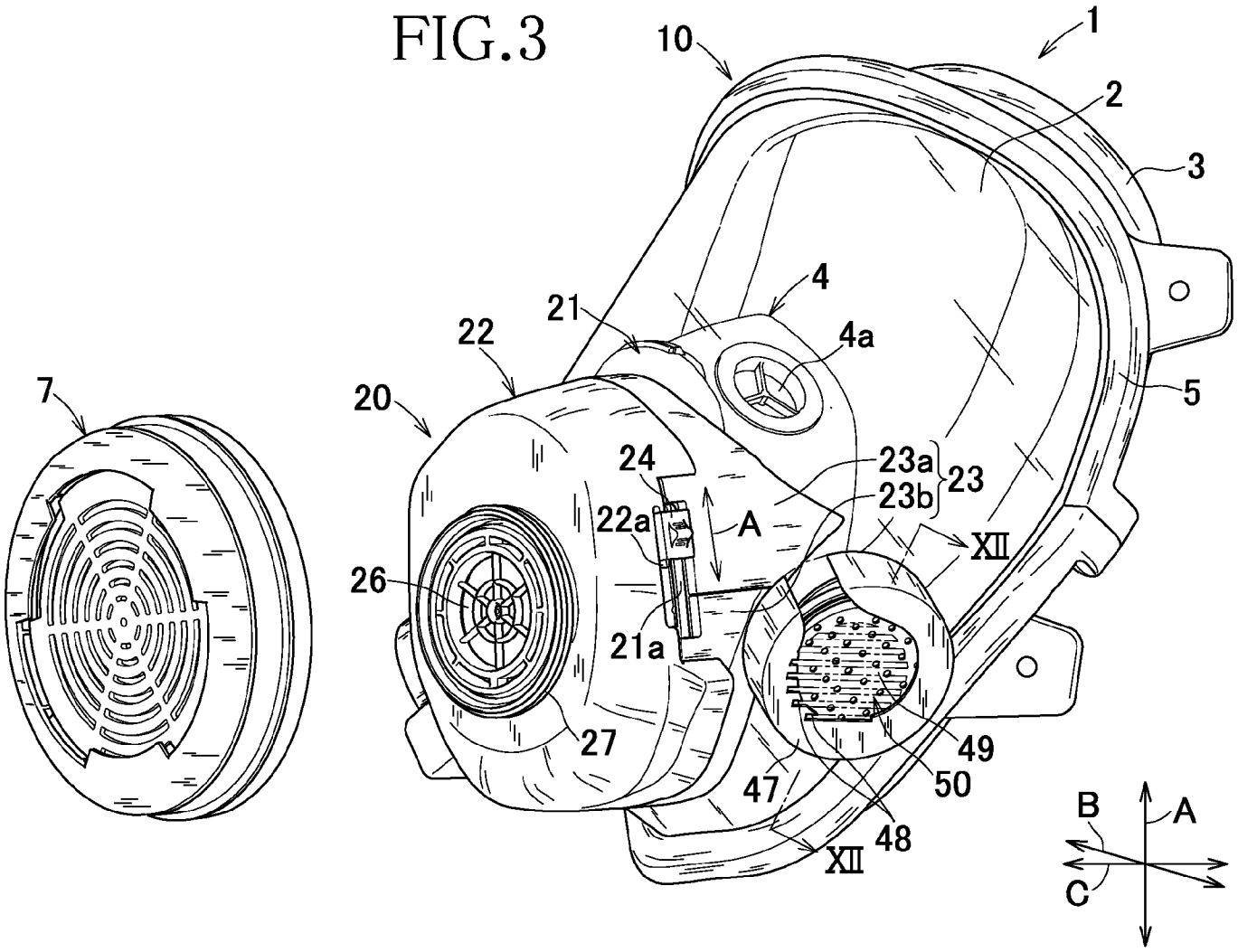
FIG. 3 is a perspective view of the mask whose left-side portion is partially broken.

FIG. 3 is a partial broken perspective view of the mask 1 in which the filtering unit 7 is in a separate state, and the illustration of the adjustable straps 6 is omitted, and the right-side surface portion of the mask 1 is represented. A speaking diaphragm 50 is mounted in the eyepiece 2 of the facepiece 10, and the speaking diaphragm 50 is covered with a cover 47. The cover 47 is formed with a number of vent holes 48. The speaking diaphragm 50 is conventional one in the field of the technology, and one example includes one wherein a speech membrane (not illustrated) is interposed between two porous plates 49. Regarding the inhalation and exhalation unit 20, on the left-side surface portion of the facepiece 10, the slide piece 24 is slid upward that is slidably mounted on the rail portion 21*a* of the first inner side member 21, which allows the slide piece 24 to be inserted in the slide groove 22*a* formed in the first outer side member 22, whereby the first inner side member 21 and the first outer side member 22 are integrated via the slide piece 24. When the slide piece 24 is slid downward, the first inner side member 21 and the first outer side member 22 are released from the state where both are integrated into one and brought into a separable state on the left-side surface portion of the facepiece 10. The first outer side member 22, which is detachable on the left-side surface portion of the facepiece 10, can be demounted from the first inner side member 21. The first check valve 4*a* is mounted on the upper portion of the nose cup 4.

Figure 4:
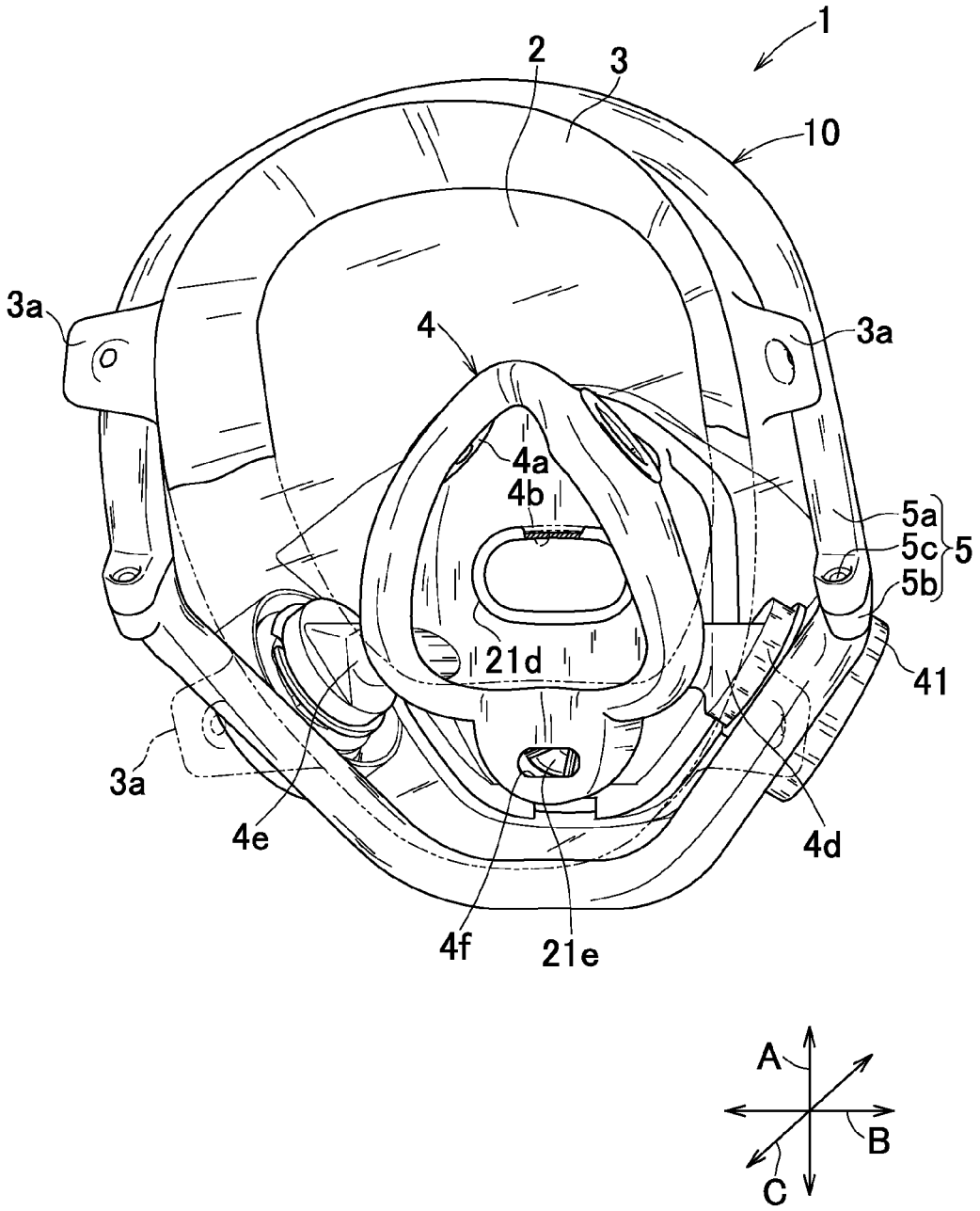
FIG. 4 is a partial broken view of the mask viewed from the back.

FIG. 4 is a partial broken view of the mask 1 viewed from the back, in which the illustration of the adjustable straps 6 is omitted, and part of the face contact pad 3 is cut in order to clarify the structure of the inner side of the mask 1. An elliptical opening 4*b* (see FIG. 6) extended in the crosswise direction B in the central portion of the crosswise direction B is formed in the nose cup 4, and the peripheral edge portion of the opening 4*b* is elastically deformed, thereby detachably fitting with an elliptical mounting portion 21*d* formed in the first inner side member 21. An opening 4*f* for removal of sweat is formed in the lower portion of the nose cup 4. A right tubular portion 4*d* is extended from the right-side portion of the nose cup 4 to the eyepiece 2, and a left tubular portion 4*e* is extended from the left-side portion of the nose cup 4 to the eyepiece 2. A plurality of adjustable straps mounting portions 3*a* are formed in the face contact pad 3. In the frame 5 to fix the face contact pad 3 on the peripheral edge portion of the eyepiece 2, an upper half body 5*a* and a lower half body 5*b* are integrated with a screw 5*c*. The inner end section of a storage portion for the loudspeaker unit 40 is visible on the inner surface of the right-side portion of the eyepiece 2, and the inner end section of a storage portion for the speaking diaphragm 50 is visible on the inner surface of the left-side portion.

Figure 5:
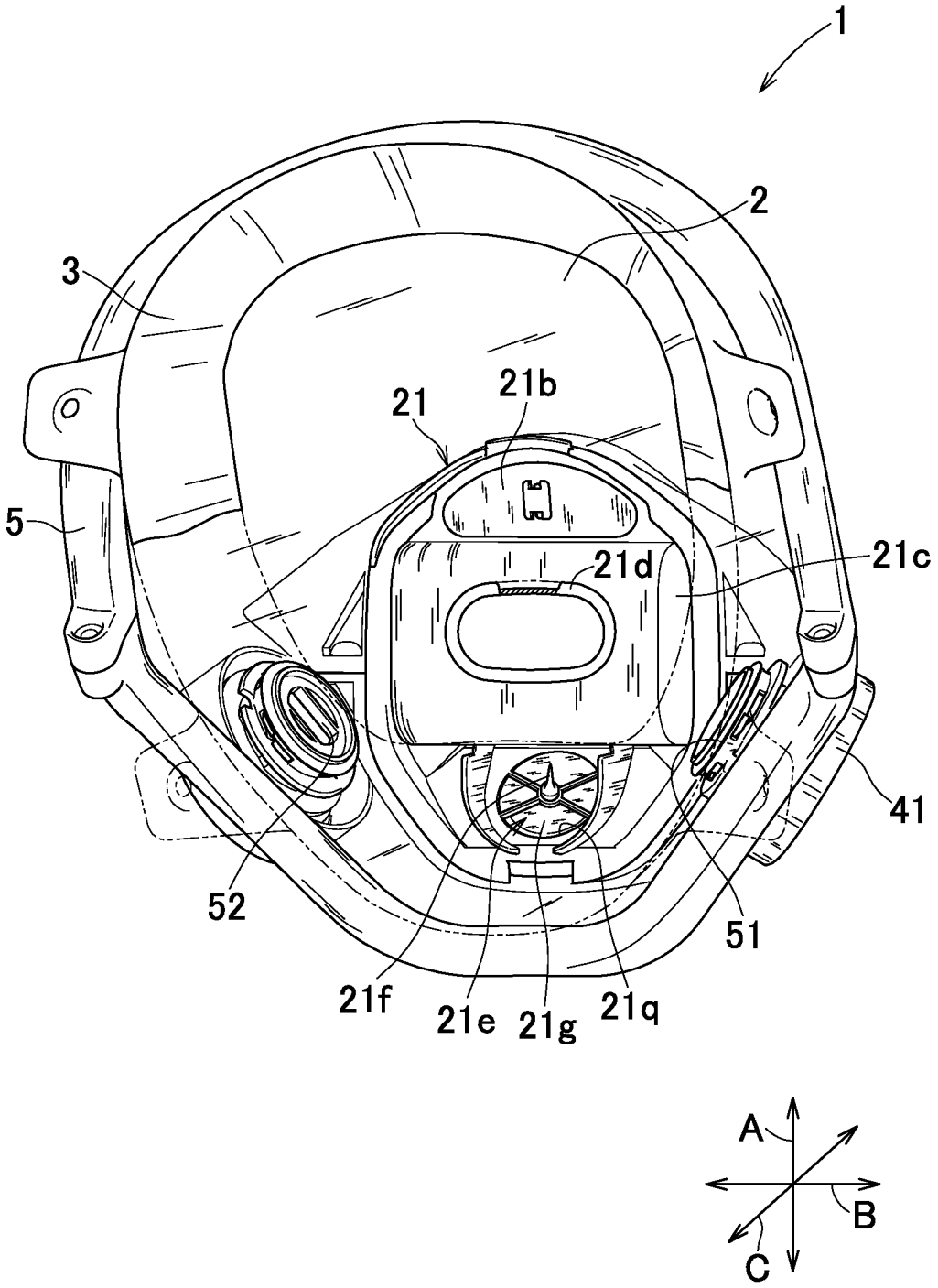
FIG. 5 is a view in which a nose cup is removed, which is similar to FIG. 4.

FIG. 5, which is similar to FIG. 4, represents the inner structure of the mask 1 by removing the nose cup 4 in FIG. 4. On the inner side of the mask 1, a second check valve 21*b* for inhalation is mounted at the upper portion of the first inner side member 21, and a power source storage unit 21*c* (see FIG. 6) and a mounting portion 21*d* for the nose cup 4 are formed at the lower portion of the second check valve 21*b*. An exhalation hole 21*q* for discharge of exhaled air is formed in a circle on the whole and partitioned into a plurality of sections at the lower portion of the first inner side member 21, and a check valve 21*e* for exhalation is closably mounted so as to cover the exhalation hole 21*q* from the outer surface side of the first inner side member 21. The check valve 21*e*, whose structure is illustrated in detail in FIG. 7 described later, includes a disc-shaped umbrella portion 21*g*, and a valve core portion 21*f* is formed in the center of the umbrella portion 21*g*.

Figure 6:
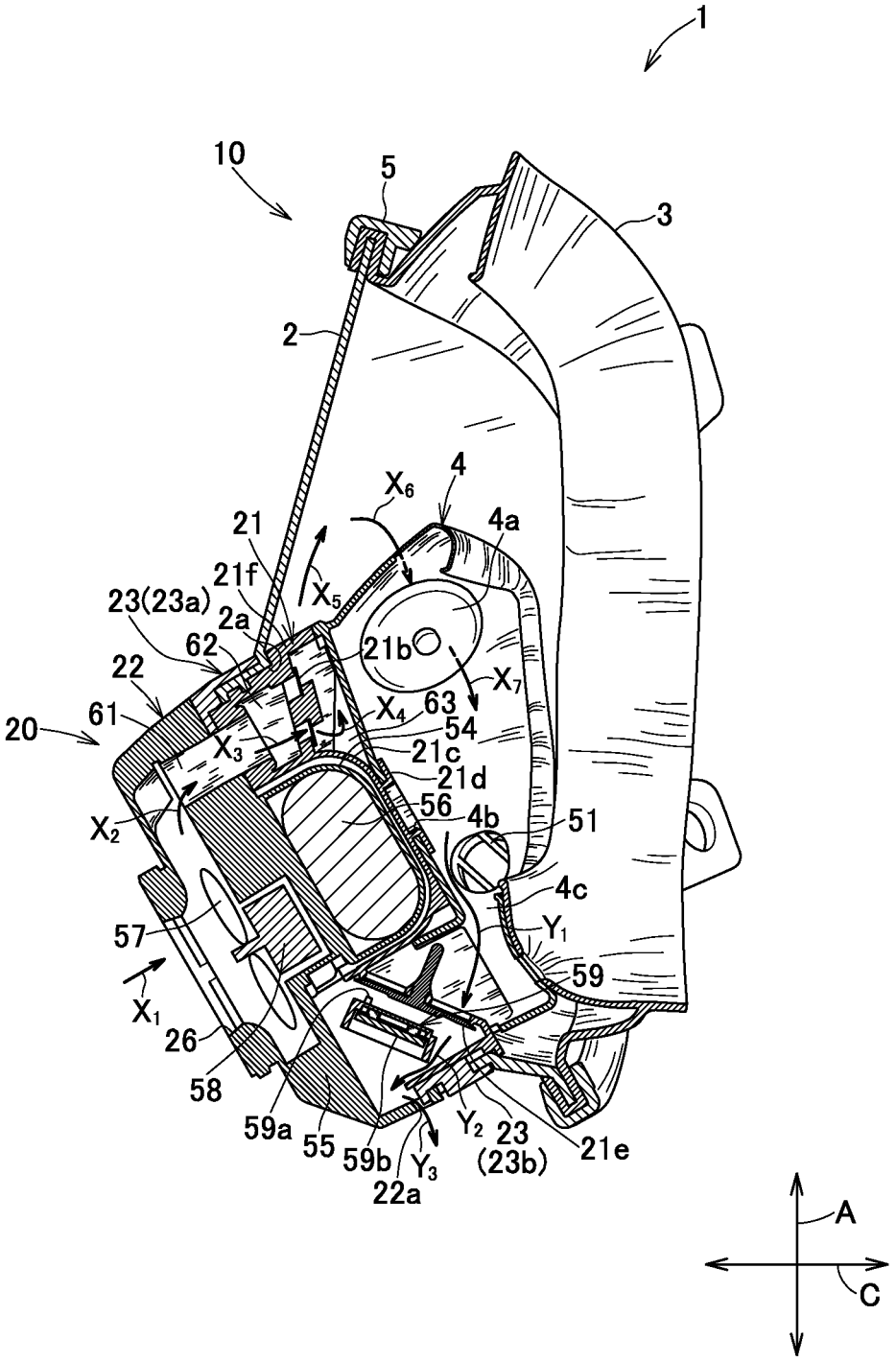
FIG. 6 is a cross-sectional view of the mask taken along the line VI-VI of FIG. 1.

FIG. 6 is a cross-sectional view of the mask 1 taken along the line VI-VI of FIG. 1, and the line VI-VI is positioned so as to equally divide the width of the mask 1. Regarding the mask 1 in the drawing, the filtering unit 7 is removed from the facepiece 10. The inhalation and exhalation unit 20 in the mask 1 includes a power source storage box 54, and a power source 56 such as a secondary battery, which forms a power source unit in the mask 1, is removably stored in the box 54. The inhalation and exhalation unit 20 includes a fan 57 and a motor 58, both of which form a blower unit for inhalation, on the inner side of an opening 26 for inhalation, that is, to the rear of the front-and-back direction C of the opening 26 for inhalation, and the motor 58 is electrically coupled to a control unit 59 incorporated in the inhalation and exhalation unit 20. The control unit 59 is coupled to the power source 56 and can control the rotation of the fan 57 via the motor 58. The control unit 59 can also switch between an operational state and a non-operational state of the loudspeaker unit 40.

In FIG. 6, air, which is filtered through the filtering unit 7 for the purpose of inhalation, flows in the direction illustrated by arrows X1 to X7, enters the facepiece 10, and heads for the nostrils and the mouth (both of which are not illustrated) of a wearer. Air as exhalation flows in the direction illustrated by arrows Y1 to Y7 and is discharged from the inhalation and exhalation unit 20. Specifically, the filtrated air, which passes through the filtering unit 7 by means of the inhalation movement of the wearer and/or the rotation of the fan 57, proceeds to the direction illustrated by the arrows X1 and X2 and passes through an airway 61, and further proceeds in the direction illustrated by the arrows X3, passes through an airway 62 formed in the first inner side member 21, and opens the second check valve 21*b*. The air further proceeds in the direction illustrated by the arrows X4, passes through a gap 63 formed between the first inner side member 21 and the nose cup 4, makes an entry into the inner side of the eyepiece 2, transfers in the direction illustrated by the arrows X5 and X6, opens the first check valve 4*a*, makes an entry into the inner side of the nose cup 4, thereby being used as inhalation.

Also, in FIG. 6, the air as exhalation proceeds in the direction illustrated by the arrows Y1, passes through an exhalation path 4*c* formed at the lower portion of the nose cup 4, and opens the check valve 21*e* for exhalation. The air proceeds in the direction illustrated by the arrows Y2 and Y3 and is discharged from the inhalation and exhalation unit 20 by way of an exhalation hole 22*a* formed in the first outer side member 22.

The mask 1 in FIG. 6 includes a sensor 59*a* that forms a detection unit according to the present invention, in addition to the control unit 59. The control unit 59 can bring the sensor 59*a* into an electric power supply state and a non-electric power supply state, and the sensor 59*a* brought into the electric power supply state always monitors the opening degree of the check valve 21*e* for exhalation, for example, at time intervals of 0.01 to 100 msec (microsecond) and transmits information on the opening degree to a control circuit 59*b*. The control circuit 59*b* always determines whether or not the opening degree of the check valve 21*e* for exhalation, which is the information to be transmitted, corresponds to an opening degree having a predetermined amount set in advance as a determination reference in the control circuit 59*b* or having the predetermined amount or more. When the control circuit 59*b* determines that the opening degree of the check valve 21*e* for exhalation corresponds to an opening degree having the predetermined amount or having the predetermined amount or more, the control circuit 59*b* concludes that the wearer is in an exhalation movement and controls the motor 58 so as to decelerate or stop the rotation of the fan 57 at least for part of a time period during which the exhalation movement is continued, whereas the control circuit 59*b* applies a voltage from the power source 56 to the loudspeaker unit 40 such that the loudspeaker unit 40 is placed in an operational state.

In contrast, when the control circuit 59*b* determines that the opening degree of the check valve 21*e* for exhalation is less than the predetermined amount, the control circuit 59*b* concludes that the wearer is in an inhalation movement and controls the motor 57 so as to rotate at a high speed, which allows the fan 57 to send the amount of air or more that is required for the wearer to inhale, whereas the control circuit 59*b* does not apply a voltage from the power source 56 to the loudspeaker unit 40 such that the loudspeaker unit 40 is placed in a non-operational state, at least for part of a time period during which the inhalation movement is continued.

As one example, a photo interrupter, which is an optical sensor, may be used for the sensor 59*a* in FIG. 6. The photo interrupter includes a light emitting diode and a transistor receiver, and the position of the photo interrupter in the mask 1 is selected such that infrared rays emitted from the light emitting diode are reflected on the external surface of the check valve 21*e* for exhalation and enter the transistor receiver. The control circuit 59*b* compares information from the photo interrupter with the determination reference, so that the control circuit 59*b* can determine whether or not the opening degree of the check valve 21*e* for exhalation is equal to the predetermined amount, or equal to or higher than the predetermined amount.

Regarding the mask 1 in which the loudspeaker unit 40 is operated in the above-mentioned manner by use of the control circuit 59*b*, electric power is not wastefully consumed by supplying electric power to the loudspeaker unit 40 at all times. This is because it is mainly conceivable that, when the wearer can utter a voice, the wearer is not in the inhalation movement but in the exhalation movement. Accordingly, in the entire period of time during which the inhalation movement is performed, it is not only unnecessary to supply the electric power to the loudspeaker unit 40, and but also lead to the amplification of noise involved with the inhalation movement by means of the loudspeaker unit 40, which causes the leakage of the noise to the outside of the mask 1. Regarding the loudspeaker unit 40 and the motor 58, when the motor 58 is not required to be rotated, the loudspeaker unit 40 is placed in an operational state, whereas when the motor 58 is rotated in a high speed, the loudspeaker unit 40 is placed in a non-operational state, which makes it possible to efficiently use one power source 56 and reduce the size of the mask 1 and the number of components.

However, according to knowledge that the inventor of the present invention has acquired, at an initial stage of the inhalation movement during switching from the exhalation movement to the inhalation movement, the loudspeaker unit 40 placed in an operational state is effective in clearly grasping the portion of the end of words uttered by the wearer and amplifying the voice. Accordingly, regarding the preferred example of the control circuit 59*b* of the present invention, when the loudspeaker unit 40 is set to an operational state based on the information from the sensor 59*a*, the operational state is continued for a time period of 0.01 to 2 seconds for each time the loudspeaker unit 40 is set to the operational state. In this manner, the impediment to the amplification of the end of words through the loudspeaker can be prevented. As a time during which the loudspeaker unit 40 of the mask 1 in use is in an operational state becomes longer, the electric power consumption of the power source unit 59 tends to be increased. Also, regarding the settings of the opening degree of the check valve 21*e* for exhalation, which are settings for the determination reference with regard to the operational state and the non-operational state of the loudspeaker unit 40, the smaller the opening degree is set, the more remarkable the tendency is. Accordingly, regarding the mask 1, it is preferable that the determination reference with regard to the operational state and the non-operational state of the loudspeaker unit 40 be set so as to increase the opening degree of the check valve 21*e* for exhalation as much as possible, and a time during which the loudspeaker unit 40 is in an operational state per unit time be shortened. However, when the opening degree of the check valve 21*e* for exhalation is set so as to increase, as described above, there occurs a problem in that it is likely that the end of words uttered by the wearer is not amplified. In order to solve the problem, the settings for the determination reference with regard to the operational state and the non-operational state of the loudspeaker unit 40 of the preferable mask 1 are set so as to increase the opening degree of the check valve 21*e* for exhalation as much as possible, and a time during which the loudspeaker unit 40 is in an operational state per unit time is shortened, whereas when the loudspeaker unit 40 is set to the operational state once based on the information from the sensor 59*a*, the operational state is continued for a time period of 0.01 to 2 seconds for each time the loudspeaker unit 40 is set to the operational state. The action of the control circuit 59*b* is provided in the above-mentioned manner, so that the impediment to the amplification of the end of words through the loudspeaker can be prevented. Additionally, effective control can be performed in terms of the operational state and the non-operational state of the loudspeaker unit 40.

Also, regarding the present invention, it may be such that the control unit 59 compares information transmitted from the sensor 59*a* for every predetermined time interval with the determination reference and controls so as to bring the loudspeaker unit 40 into any of an operational state and a non-operational state, and a first control state of a case where the control unit 59 compares first information, which is one piece of the information, with the determination reference and controls so as to bring the loudspeaker unit 40 into any of an operational state and a non-operational state is continued until second information is transmitted after a lapse of a predetermined time as new information, and the first control state is released as a consequence of the transmission of the second information.

Furthermore, regarding the control circuit 59*b* of the present invention, the determination reference used to determine whether the loudspeaker unit 40 is brought into an operational state or a non-operational state based on the information received from the sensor 59*a* may be equal to or different from the determination reference used to determine whether or not the blower unit inclusive of the motor 58 is brought into an operational state based on the information received from the sensor 59*a*. For example, the control circuit 59*b* brings the loudspeaker unit 40 into the operational state, while bringing the blower unit into the non-operational state, based on a result of comparing the information received from the sensor 59*a* with one determination reference in the control circuit 59*b*. Also, it may be such that the control circuit 59*b* compares information on a first opening degree of the check valve 21*e* for exhalation from the sensor 59*a* with a first determination reference, determines whether or not the loudspeaker unit 40 is brought into an operational state, compares information on a second opening degree from the sensor 59*a*, which is different from the first opening degree of the check valve 21*e* for exhalation, with a second determination reference, which is different from the first determination reference, and determines whether or not the blower unit is brought into an operational state. Furthermore, regarding the present invention, it may be such that the control circuit 59*b* of the control unit 59 is used for the loudspeaker unit 40, and a second control circuit, which is a separate body with respect to the control circuit 59*b* of the control unit 59, is used for the blower unit.

Figure 7:
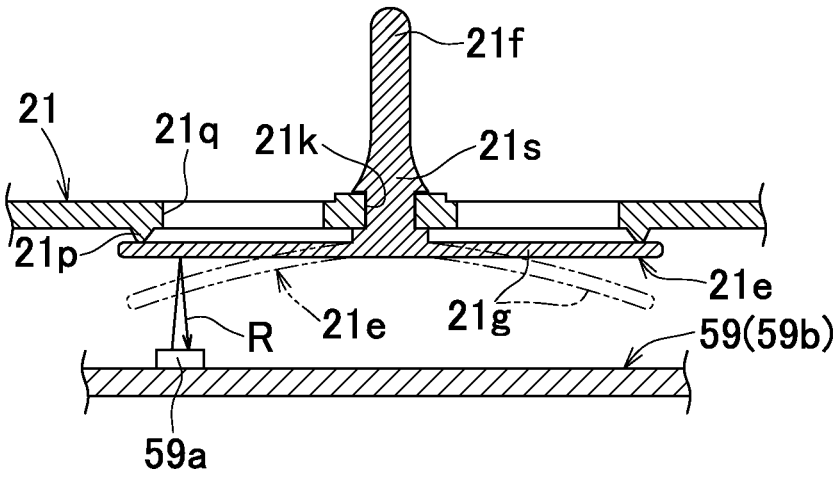
FIG. 7 is an enlarged view of a check valve for exhalation.

FIG. 7 is an enlarged view of the check valve 21*e* for exhalation in FIG. 6. In the check valve 21*e* for exhalation in FIG. 7, the umbrella portion 21*g* is in a closed state and in close contact with a valve seat 21*p* formed at the periphery of the exhalation hole 21*q* of the first inner side member 21. The check valve 21*e* for exhalation illustrated by an imaginary line represents a case where the opening degree reaches a predetermined amount. In the valve core portion 21*f* of the check valve 21*e* for exhalation, an enlarged diameter portion 21*s* is formed in the middle of the longitudinal direction. Regarding the check valve 21*e* for exhalation, the enlarged diameter portion 21*s* of the valve core portion 21*f* is elastically deformed and penetrates a valve core insertion hole 21*k* formed in the first inner side member 21, thereby being fixed.

The photo interrupter is used for the sensor 59*a* of the mask 1. The infrared rays R emitted from the light emitting diode (not illustrated) of the photo interrupter are reflected on the outer surface of the umbrella portion 21*g* and enter the transistor receiver (not illustrated) of the photo interrupter. The amount of incident infrared rays R is increased as a distance between the sensor 59*a* and the photo interrupter is decreased in response to the opening of the check valve 21*e* for exhalation, that is, as the opening degree of the check valve 21*e* for exhalation is increased. The photo interrupter described above monitors the amount of infrared rays R incident on the transistor receiver, thereby monitoring the opening degree of the check valve 21*e* for exhalation, and the photo interrupter transmits the information on the opening degree of the check valve 21*e* for exhalation to the control circuit 59*b*.

It is noted that the shape of the check valve 21*e* for exhalation is not limited to the example illustrated. For example, the check valve 21*e* for exhalation may eliminate the valve core portion 21*f*. Here, regarding the check valve 21*e* for exhalation, for example, a convex portion is formed on the outer surface side (outside air side) of the umbrella portion 21*g*, and a concave portion is formed on the inner surface side of the convex portion, and a protrusion portion fitted with the concave portion is provided in the middle of the exhalation hole 21*q* of the first inner side member 21, and the concave portion and the protrusion portion are fitted with each other, whereby the check valve 21*e* for exhalation can be mounted to the first inner side member 21. The shape of the umbrella portion 21*g* of the check valve 21*e* for exhalation may be formed in a shape apart from the disc shape. Also, the check valve 21*e* for exhalation can be mounted to the first inner side member 21 by fixing one section or plural sections thereof in the peripheral direction on the peripheral edge portion of the exhalation hole 21*q* of the first inner side member 21 and the like. Regarding the structure of the check valve 21*e* for exhalation, various structures generally used for dust masks and gas masks can be applied.

Figure 8:
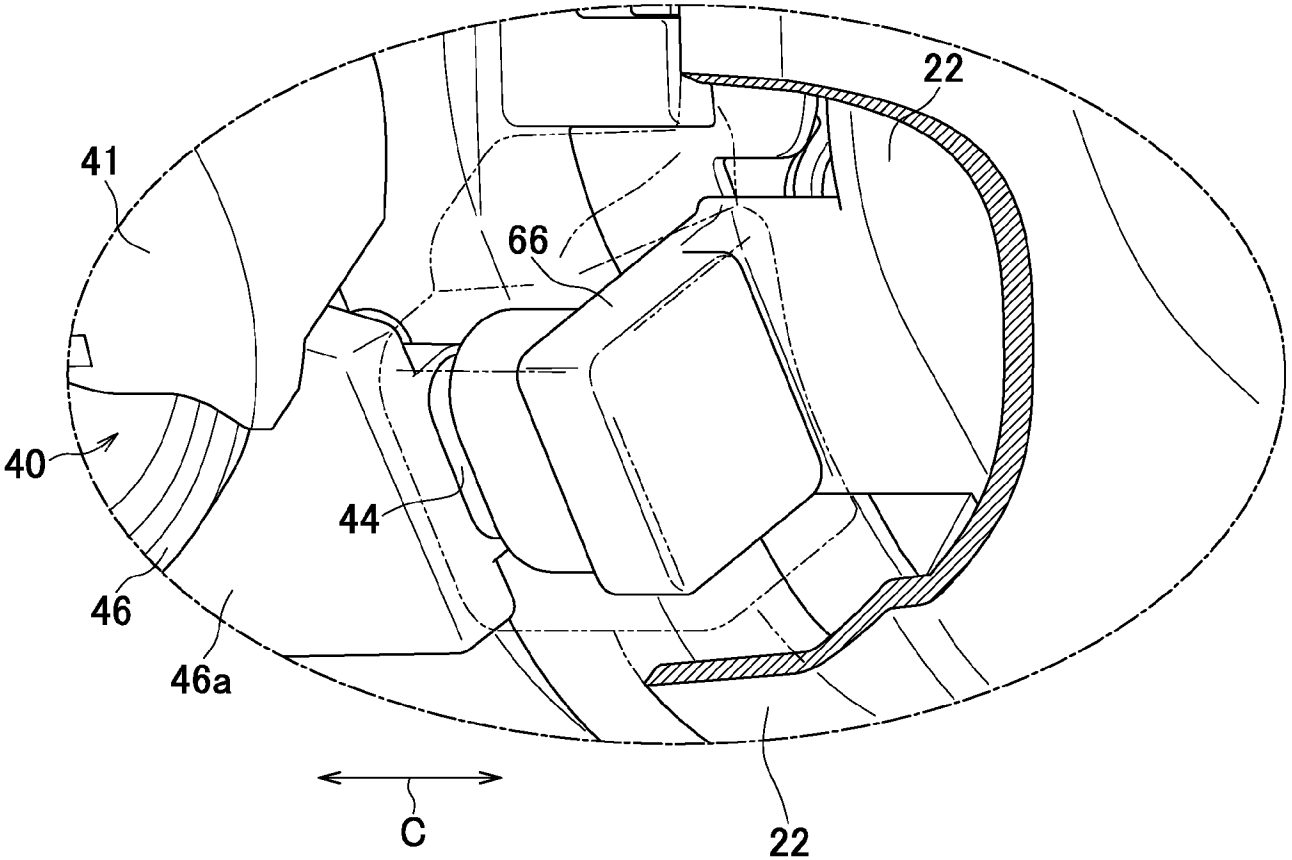
FIG. 8 is an enlarged view of a section VIII in FIG. 2.

FIG. 8 is an enlarged view of a section VIII in FIG. 2. In FIG. 8, the first outer side member 22 is also partially broken, in addition to the cover 41 for the loudspeaker unit 40. A first connector 44 is extended from the loudspeaker unit 40 to the front of the mask 1. The first connector 44 is a connector for supplying power to the loudspeaker unit 40 and providing information (see FIG. 10) on whether the loudspeaker unit 40 is brought into an operational state or a non-operational state, and part of the first connector 44 is covered by a portion 46*a* that is extended from a cylinder body portion 46 (see FIG. 9) of the loudspeaker unit 40 to the outer side of the radial direction of the cylinder body portion 46. The first connector 44 is electrically connected to a second connector 66 mounted to the first outer side member 22 in the front-and-back direction C and placed in a detachable state. The second connector 66 is connected to the power source 56 and the control circuit 59*b*.

Figure 9:
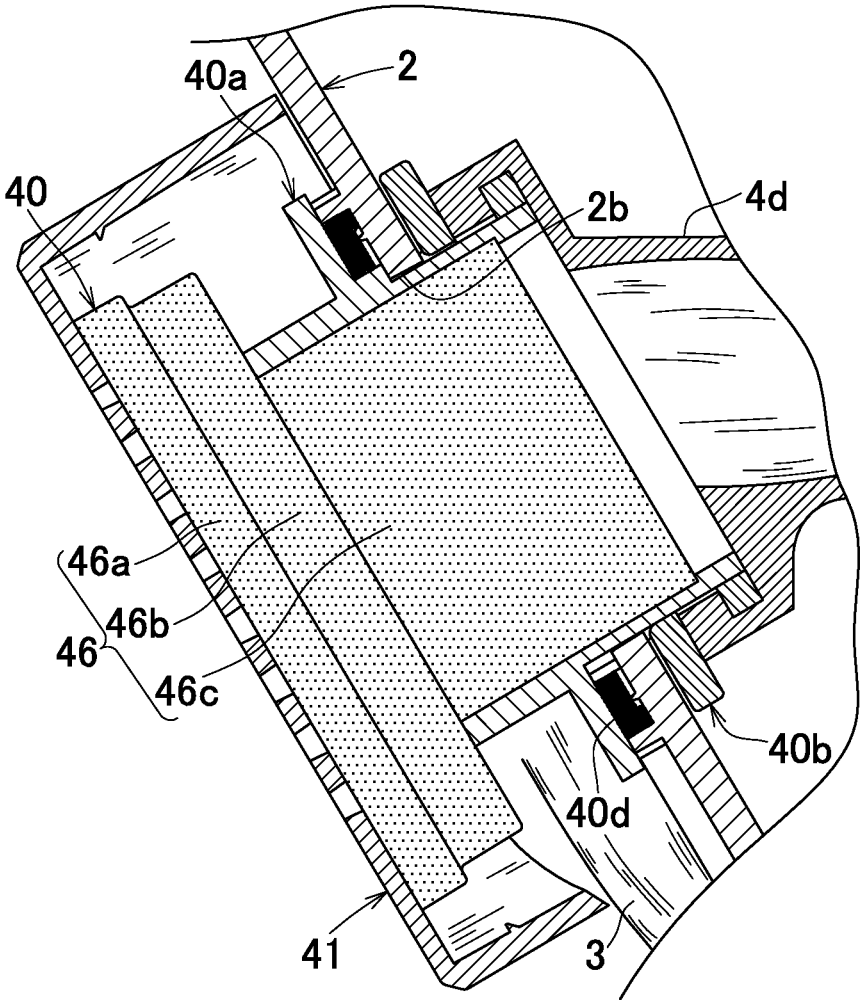
FIG. 9 is a cross-sectional view taken along the line IX-IX of FIG. 2.

FIG. 9 is a cross-sectional view taken along the line IX-IX of FIG. 2, and the loudspeaker unit 40 is illustrated not by the cross-sectional view thereof but by the side view thereof. The loudspeaker unit 40 includes the cylinder body portion 46 formed of hard synthetic resin. The cylinder body portion 46 includes a large diameter portion 46*a*, a middle diameter portion 46*b*, and a small diameter portion 46*c*. The large diameter portion 46*a* includes a speaker (not illustrated) therein, and the small diameter portion 46*c* includes a microphone and an amplifier (each of which is not illustrated) therein. The small diameter portion 46*c* is inserted into a through hole 2*b* formed in the right-side portion of the eyepiece 2. In the through hole 2*b*, a first ring 40*a* inserted from the outer side of the eyepiece 2 and a second ring 40*b* positioned on the inner side of the eyepiece 2 are detachably fitted with each other in the circumferential direction by means of a mechanism not illustrated in the drawing. The inner circumferential surface of the right tubular portion 4*d* of the nose cup 4 is elastically in close contact with the end portion of the loudspeaker unit 40 positioned on the inner side of the eyepiece 2 by the action of expansion and contraction. The loudspeaker unit 40 is covered with the removable cover 41 on the outer side of the eyepiece 2.

Figure 10:
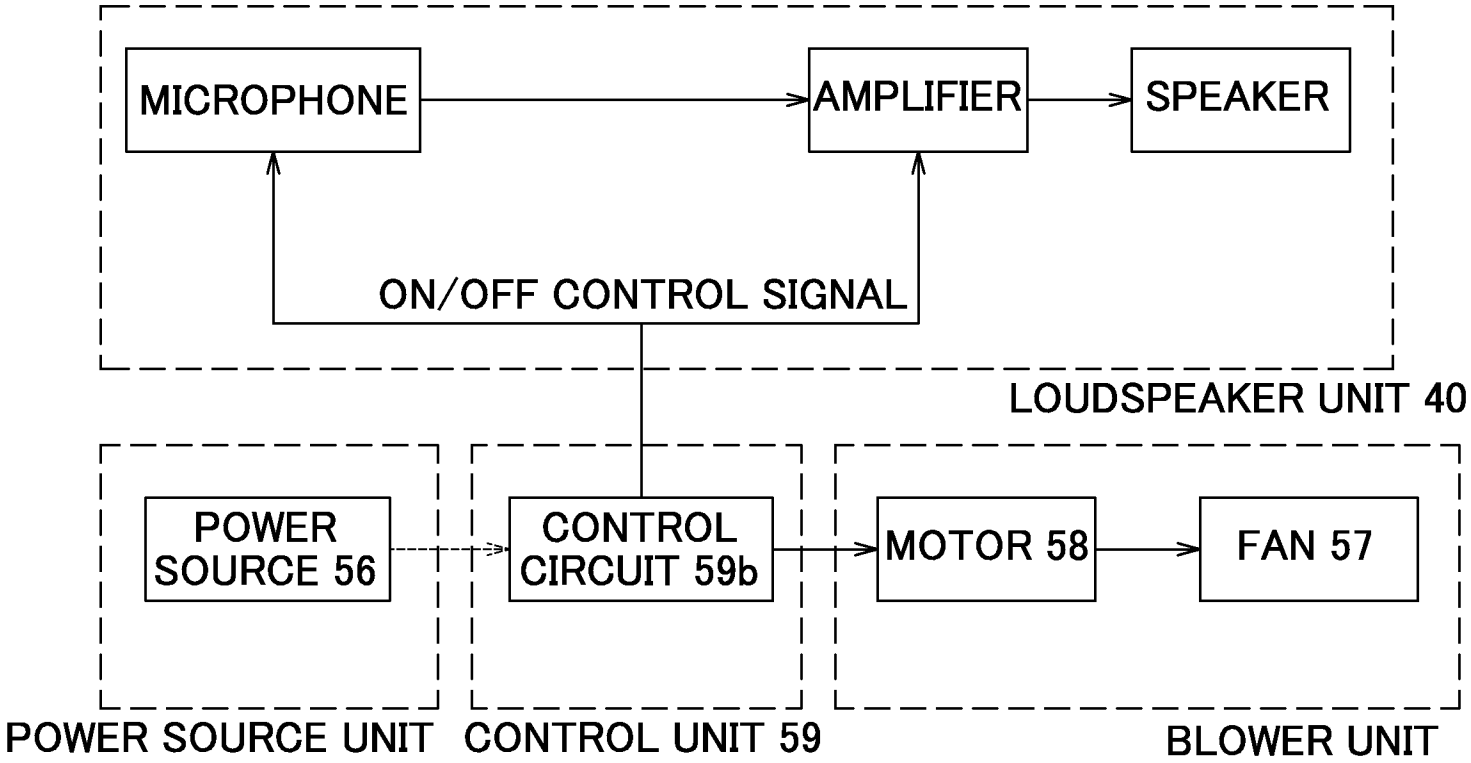
FIG. 10 is a block diagram inclusive of a control unit, a loudspeaker unit, and a blower unit, as one example.

FIG. 10 is one example of a block diagram used for the loudspeaker unit 40 and the blower unit, and the control unit 59 is also illustrated. Regarding the loudspeaker unit 40, a voice collected by the microphone is amplified by an amplifier whose output is approximately 1 W, and the amplified voice can be outputted. In the block diagram, a 7.4 V lithium battery is used as one example of the power source 56, and the lithium battery is used not only as the power source of the control circuit 59*b* but also as the power source of the loudspeaker unit 40 and the blower unit. The control circuit 59*b* detects the opening degree of the check valve 21*e* for exhalation by means of the sensor 59*a* and compares the information transmitted from the sensor 59*a* with the determination reference, and when it is determined that the opening degree of the check valve 21*e* for exhalation does not reach a predetermined amount, the control circuit 59*b* applies a predetermined voltage to the motor 58 and controls the blower unit so as to rotate the fan 57 at a high speed.

The typical example of the sensor 59*a* used in the present invention includes a sensor used as a detection unit that detects any of variation amount and presence or absence of variation in an inner pressure response portion, which is a portion whose state is varied in response to change in the inner pressure of the facepiece 10, and that transmits the detection results as information, and the typical example is represented by the photo interrupter described above. Also, the first check valves 4*a* for inhalation and the second check valve 21*b* for inhalation illustrated in the example may be applied to the inner pressure response portion, in place of the check valve 21*e* for exhalation. In whichever check valve, an open/close valve such as the check valve 21*e* for exhalation and the first check valves 4*a* for inhalation is suitable for using as the inner pressure response portion.

Figure 11:
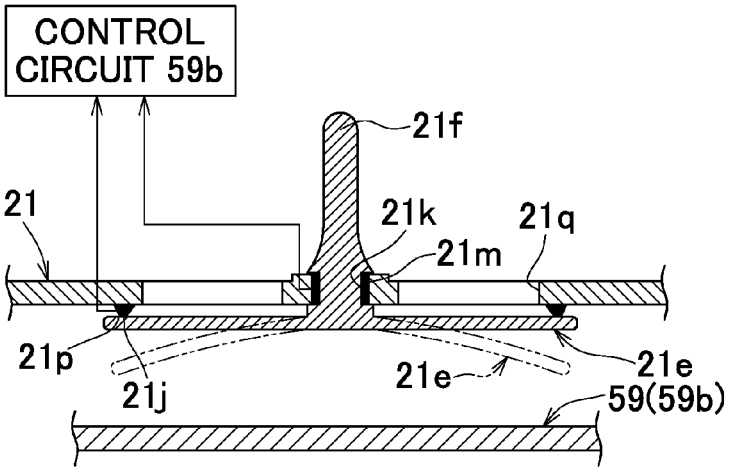
FIG. 11 is an enlarged view of the check valve for exhalation illustrating one example of embodiments.

FIG. 11 is an enlarged view of the check valve 21*e* for exhalation used as the sensor 59, which is illustrated as one aspect and similar to FIG. 7. However, the check valve 21*e* for exhalation in FIG. 11 is formed of an elastic material having conductivity. Also, an electric contact point 21*j* is formed of a conductive material such as metal at least at one part in the circumferential direction of the valve seat 21*p* of the first inner side member 21. An electric contact point 21*m* is formed of the conductive material such as metal at least at one part of the inner circumferential surface of the valve core insertion hole 21*k* formed in the first inner side member 21. These contact points 21*j* and 21*m* are respectively electrically connected to the control circuit 59*b*, and a slight voltage from the control circuit 59*b* is applied to any one of the contact points 21*j* and 21*m*.

When the wearer is in an exhalation movement, the check valve 21*e* for exhalation is opened, which provides an electrically non-contact state between the check valve 21*e* for exhalation and the valve seat 21*p*, whereby a voltage is not applied between the contact point 21*j* and the contact point 21*m*. In this state, the control circuit 59*b* determines that the check valve 21*e* for exhalation is opened and brings the loudspeaker unit 40 into an operational state.

When the check valve 21*e* for exhalation is closed as illustrated, an electrically contact state is provided between the check valve 21*e* for exhalation and the valve seat 21*p*, which provides an electrically contact state between the contact point 21*j* and the contact point 21*m*, whereby a voltage is applied between the contact point 21*j* and the contact point 21*m*. Also, a slight voltage from the check valve 21*e* for exhalation is applied, so that the control circuit 59*b* determines that the check valve 21*e* for exhalation is closed and brings the loudspeaker unit 40 into a non-operational state.

Thus, the control circuit 59*b* that uses the check valve 21*e* for exhalation in FIG. 11 can control the loudspeaker unit 40 based on whether or not the check valve 21*e* for exhalation in contact with the valve seat 21*p*, that is, based on the presence or absence of variation of the check valve 21*e* for exhalation in response to change in the inner pressure of the mask 1.

Also, according to knowledge that the inventor of the present invention has acquired, at an initial stage of the inhalation movement during switching from the exhalation movement to the inhalation movement, the loudspeaker unit 40 placed in an operational state is effective in clearly grasping the portion of the end of words uttered by the wearer and amplifying the voice. Regarding the preferred example of the control circuit 59*b* of the present invention based on the knowledge, at a stage in which the respiration of the wearer changes from the exhalation movement to the inhalation movement, the check valve 21*e* for exhalation is opened with respect to the valve seat 21*p*, and a gap between the check valve 21*e* for exhalation and the valve seat 21*p* is in an electrically non-contact state, and a voltage is not applied between the contact point 21*j* and the contact point 21*m*, whereby the control circuit 59*b* determines that the check valve 21*e* for exhalation is opened, and the loudspeaker unit 40 is placed in an operational state. At a stage in which the wearer is in the inhalation movement, the check valve 21*e* for exhalation is closed on the valve seat 21*p*, and the gap between the check valve 21*e* for exhalation and the valve seat 21*p* is in an electrically contact state, and a voltage is applied between the contact point 21*j* and the contact point 21*m*, whereby the control circuit 59*b* determines that the check valve 21*e* for exhalation is closed and tries to bring the loudspeaker unit 40 into a non-operational state. However, regarding the preferred control circuit 59*b*, when the control circuit 59*b* sets the loudspeaker unit 40 to an operational state, a high priority is assigned to the control of bringing the loudspeaker unit 40 into an operational state, with respect to the following control of bringing the loudspeaker unit 40 into a non-operational state, and control is made such that the operational state is continued only for a period of 0.01 to 2 seconds, so that even when the check valve 21*e* for exhalation and the valve seat 21*p* are closed due to the inhalation movement, the loudspeaker unit 40 is prevented from being immediately brought into the non-operational state. The loudspeaker unit 40 acts in the above-mentioned manner, so that the impediment to the amplification of the end of words through the loudspeaker can be prevented.

Figure 12:
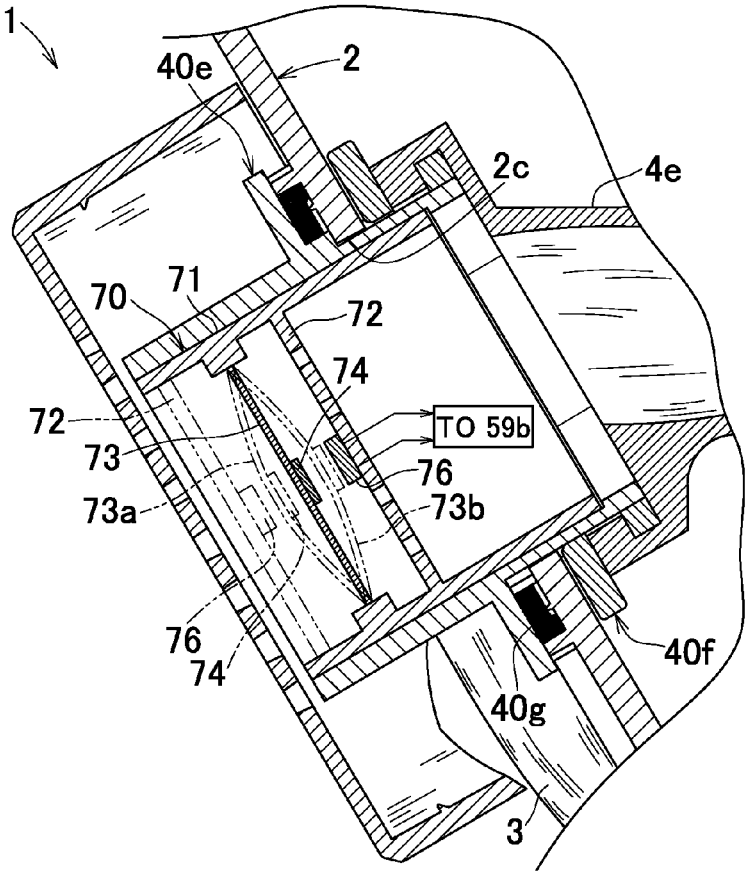
FIG. 12 is a cross-sectional view taken along the line XII-XII of FIG. 3, illustrating one example of embodiments.

FIG. 12 is a cross-sectional view taken along the line XII-XII of FIG. 3, illustrating one example of the inner pressure response portion of the mask 1. However, in the mask 1 in FIG. 12, a unit 70 of a diaphragm that forms a pressure response portion is used, in place of the speaking diaphragm 50 in FIG. 3. The unit 70 includes a rigid cylinder body portion 71, a breathable supporting plate portion 72 integrally formed with the rigid cylinder body portion 71 in the inside of the hard cylinder body portion 71, and a disc-shaped diaphragm valve 73 formed of an elastic material such as synthetic rubber. A permanent magnet 74 is attached to the inner surface of the central portion of the diaphragm valve 73, and a magnetic sensor 76 that uses a Hall element, a sensitive magnetic element, or the like is attached to the supporting plate portion 72 so as to face the permanent magnet 74, so that the magnetic force from the permanent magnet 74 can be detected. The cylinder body portion 71 is attached to the through hole 2*c* formed in the eyepiece 2 by the intermediary of ring-shaped members 40*e* and 40*f* and a packing 40*g*. The cylinder body portion 71 is linked with the left tubular portion 4*e* of the nose cup 4 and placed in an open state to the inner side of the nose cup 4.

When the wearer is in the exhalation movement, the diaphragm valve 73 moves to the external side of the facepiece 10 as illustrated by an imaginary line 73*a* such that the diaphragm valve 73, to which the permanent magnet 74 is attached, is detached from the magnetic sensor 76. Also, when the wearer is in the inhalation movement, the diaphragm valve 73 moves to the inner side of the facepiece 10 as illustrated by an imaginary line 73*b* such that the diaphragm valve 73, to which the permanent magnet 74 is attached, comes close to the magnetic sensor 76. The magnetic sensor 76 detects the magnetic force from the permanent magnet 74, thereby always monitoring the position of the diaphragm valve 73, in other words, variation amount from the diaphragm valve 73 or variation amount from the magnetic sensor 76, which is illustrated by a solid line and transmitting information on the variation amount to the control circuit 59*b*. The control circuit 59*b* compares the information received with the determination reference, thereby determining whether to bring the loudspeaker unit 40 into an operational state.

It is noted that, in FIG. 12, the position of the supporting plate portion 72 can be changed to the position of the supporting plate portion 72 illustrated by the imaginary line. However, the supporting plate portion 72 illustrated by the imaginary line has non-breathability, wherein the magnetic sensor 76 is attached to the supporting plate portion 72.

Figure 13:
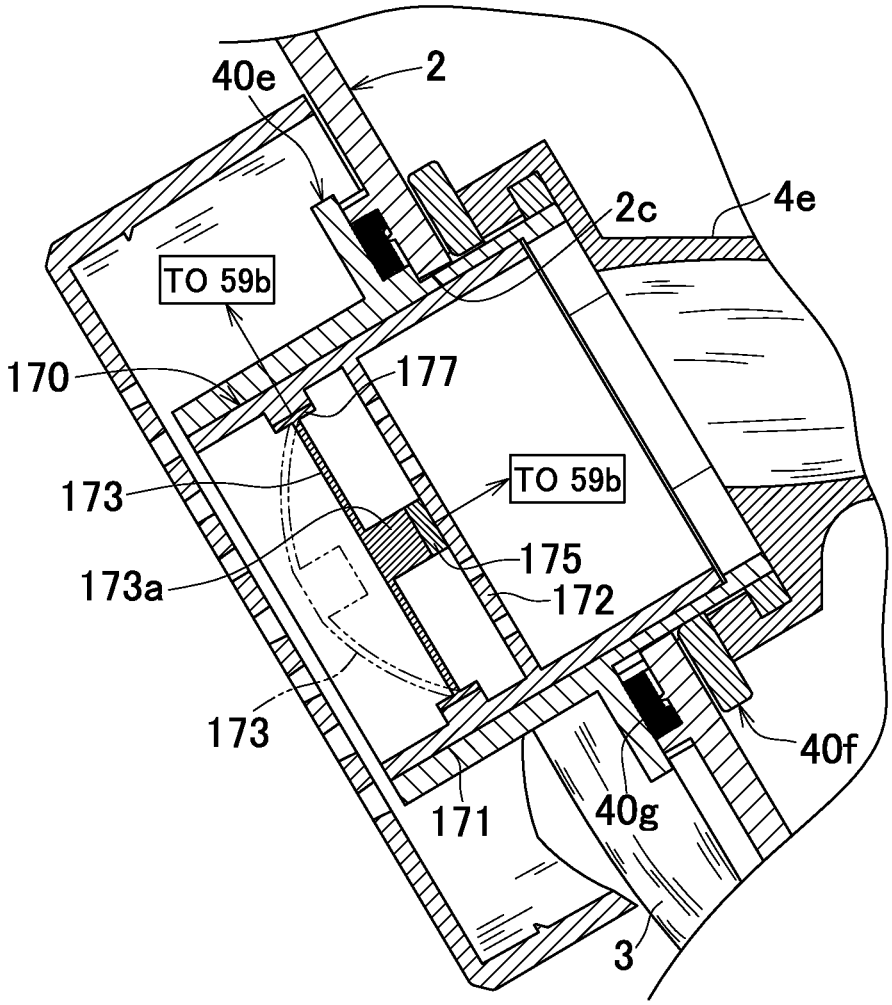
FIG. 13 is a view of illustrating one example of embodiments, which is similar to FIG. 12.

FIG. 13 is a cross-sectional view of the unit 170 exemplified in a mode which is different from the mode of the unit 70 of the diaphragm in FIG. 12, and the cross-sectional view is similar to that of FIG. 12. The unit 170 includes a diaphragm valve 173, for example, formed of a disc-shaped elastic member having conductivity. The peripheral edge portion of the diaphragm valve 173 is connected to an electric contact point 177 formed of a conductive member such as metal at least at one part of inner circumferential surface of a cylinder body portion 171 of the unit 170. On a breathable supporting plate portion 172 formed in the cylinder body portion 171, an electric contact point 175 is formed of a conductive member so as to face a protrusion portion 173*a* formed on the inner surface of the diaphragm valve 173. The contact points 175 and 177 are electrically connected to the control circuit 59*b*, a slight voltage from the control circuit 59*b* is applied to any one of the contact points.

In FIG. 13, at the moment when the wearer wears the mask 1, and the wearer is in a breathless state, and the inside and outside of the facepiece 10 is under atmospheric pressure, the protrusion portion 173*a* electrically comes in contact with the contact point 175, and the control circuit 59*b* detects a slight voltage from the contact points 175 and 177. When the wearer is in an exhalation movement, the diaphragm valve 173 correspond to the diaphragm valve 173 in a state illustrated by the imaginary line, and the protrusion portion 173*a* and the contact point 175 fall into an electrically non-contact state, and a voltage is not applied between the contact points 175 and 177. At this time, the control circuit 59*b* determines that the wearer is in the exhalation movement and controls so as to bring the loudspeaker unit 40 into an operational state. When the wearer is in an inhalation movement, the protrusion portion 173*a* electrically comes in contact with the contact point 175, and the contact points 175 and 177 fall into an electrically conductive state, and a slight voltage is applied between the contact points 175 and 177. When the control circuit 59*b* detects that a slight voltage from the diaphragm valve 173 is applied, the control circuit 59*b* determines that the mask 1 is in a breathless state or an inhalation state and brings the loudspeaker unit 40 into a non-operational state. Thus, in the example of FIG. 13, the presence or absence of variation in the position of the diaphragm valve 173 with respect to the contact point 175 is provided as the determination reference of the control circuit 59*b*, thereby controlling the loudspeaker unit 40. It is noted that, for example illustrated, when the diaphragm valve 173 changes from the state illustrated by the imaginary line to the state illustrated by the solid line, or when the control circuit 59*b* controls so as to bring the loudspeaker unit 40 into an operational state immediately before the change, it is preferable that even when the control circuit 59*b* controls so as to bring the loudspeaker unit 40 into a non-operational state after the control, the priority is given to the control of bringing the loudspeaker unit 40 into an operational state, and the operational state is continued for a period of 0.01 to 2 seconds.

Although not illustrated, in the present invention, a pressure sensor can be attached to the nose cup 4 and the like in order to detect the inner pressure of the mask 1. Here, the pressure sensor is used as both the inner pressure response portion of the mask 1 and a sensor in place of the sensor 59*a* in FIG. 6.

In the present invention, the variation amount of the inner pressure response portion, which appears in response to the change in the inner pressure of the facepiece 10, encompasses the opening degree of the open/close valve such as the check valve 21*e* for exhalation as illustrated, the shift amount from the valve seat as one example of the opening degree, the amount of deformation of the diaphragm, the variation amount of the pressure sensing portion in the pressure sensor, and the like. Also, the presence or absence of variation in the inner pressure response portion, for example, encompasses a state as to whether the open/close valve is in close contact with to the valve seat, a state as to whether the open/close valve is detached from the valve seat, a state as to whether the diaphragm is deformed, and a state as to whether the diaphragm is not deformed. The presence or absence of the variation and variation amount in the inner pressure response portion only needs to be detected by means of the detection unit such as the sensor 59*a* and the like as the presence or absence of the variation and variation amount of any of inner pressure, light, ultrasonic waves, magnetism, capacitance, electric currents, voltages, and electric resistance.

The mask 1 illustrated in the example and described above is one wherein the loudspeaker unit 40 is incorporated into a mask corresponding to the respiratory protection device (blower mask) with an electric fan, which is prescribed in JIS T 8157. The respiratory protection device according to the present invention can make combined use of a canister for absorbing poisonous gas in the mask 1 in FIG. 1 and the filtering unit 7 or can be applied as a gas mask obtained by using the canister in place of the filtering unit 7. The respiratory protection device according to the present invention can also be applied as a dust mask or a gas mask that is prescribed in the standards of national tests or JIS T 8151, 8152, and the like. The dust mask or the gas mask has structure in which air is taken in on the inner side of the facepiece 10 by the power of the lungs of the wearer who wears the mask, so that the open/close valve such as the check valve 21*e* for exhalation is placed in a state where the open/close valve is in contact with the valve seat 21*p* and the like at a time when the wearer does not breathe or does inhalate. When the open/close valve is placed in the state described above, the respiratory protection device according to the present invention can control so as to bring the loudspeaker unit 40 into a non-operational state by means of the check valve 21*e* for exhalation as the inner pressure response portion only when the check valve 21*e* for exhalation and the valve seat 21*p* are in a contact state. The respiratory protection device described above is suitable for adopting a control method of detecting the presence or absence of contact between the inner pressure response portion and a contact portion with respect to the inner pressure response portion, that is, the presence or absence of variation in the inner pressure response portion and controlling so as to bring the loudspeaker unit 40 into an operational state or a non-operational state. It is noted that a voice amplifier such as the loudspeaker unit 40, which is connected to the power source unit 56, can utilize the check valve for inhalation such as the first check valve 4*a* for inhalation and the second check valve 21*b* for inhalation as the inner pressure response portion made up of the open/close valve, in place of the check valve 21*e* for exhalation, and it is possible to substitute the diaphragm for the inner pressure response portion made up of the open/close valve, detect the presence or absence of contact between the diaphragm and the contact portion with respect to the diaphragm, and control so as to bring the loudspeaker unit 40 into an operational state or a non-operational state. Also, it is possible to not only make the control of the loudspeaker unit 40 based on the detection of the presence or absence of variation in the inner pressure response portion illustrated above, but also to detect the variation amount of the inner pressure response portion and control so as to bring the loudspeaker unit 40 into an operational state or a non-operational state. For example, the opening degree of the open/close valve is detected as the variation amount, and control can be made so as to bring the loudspeaker unit 40 into an operational state only when the opening degree is equal to a predetermined amount or equal to or less than the predetermined amount. Furthermore, the inner pressure of the facepiece is directly monitored by the pressure sensor, and control can be made so as to bring the loudspeaker unit 40 into an operational state only when the inner pressure is in a range of values to be set.

Furthermore, the respiratory protection device according to the present invention can be applied to a breathing apparatus prescribed in JIS T 8155 or an air-supplied respirator that is prescribed in JIS T 8153 in which air is supplied from an air supply, which is prepared as a separate body with respect to the mask 1, enter the inner side of the facepiece as air for inhalation via an appropriate pipe, in addition to the mask 1 illustrated in the example. Regarding the respiratory protection device with the electric fan illustrated as the mask 1 or a protection device such as the breathing apparatus and the air-supplied respirator having a method in which air for inhalation is supplied from the air supply to the inner side of the facepiece 10, there is a case where the air for inhalation is supplied for a time during which the wearer does not breathe or does inhale, and the open/close valve such as the check valve 21*e* for exhalation is in a state where the open/close valve is slightly opened with respect to the valve seat 21*p* and the like. The respiratory protection device according to the present invention such as the mask 1 illustrated in the example and the breathing apparatus, in which the open/close valve is used in the state described above, can control so as to bring the loudspeaker unit 40 into an operational state only when the check valve 21*e* for exhalation is used as the inner pressure response portion, and the opening degree of the check valve 21*e* for exhalation is detected, and the opening degree is equal to the predetermined amount or equal to or higher than the predetermined amount, so that the respiratory protection device according to the present invention is suitable for adopting the control method of detecting the variation amount of the inner pressure response portion and controlling so as to bring the loudspeaker unit 40 into an operational state or a non-operational state. The voice amplifier such as the loudspeaker unit 40, which is connected to the power source unit, can utilize the check valve for inhalation such as the first check valve 4*a* for inhalation and the second check valve 21*b* for inhalation, in place of the check valve 21*e* for exhalation as the inner pressure response portion, and it is possible to substitute the diaphragm for the inner pressure response portion made up of the open/close valve, detect the variation amount of the diaphragm, and control so as to bring the loudspeaker unit 40 into an operational state or a non-operational state. Furthermore, the pressure of the facepiece is directly monitored by the pressure sensor, and control can be made so as to bring the loudspeaker unit 40 into an operational state only when the pressure is in a range of values to be set. The mask 1 illustrated in the example is of so-called full face type, and the facepiece is a full face facepiece, but in the present invention, a mask whose facepiece is of a half face type can be applied. The power source unit 56 of the mask 1, which is incorporated into the facepiece 10 as illustrated in the example, may be a separate body that is separate from the facepiece 10, and the power source unit 56 can be replaced with one that is put into a pocket of the wearer or attached to a belt for portable use.

REFERENCE SIGNS LIST

1 Respiratory protection device (Mask)
2 Eyepiece
4 Nose cup
10 Facepiece
21*e* Inner pressure response portion (Check valve for exhalation)
40 Voice amplifier (Loudspeaker unit)
56 Power source unit
59 Control unit
59*a* Detection unit

The invention claimed is:

1. A respiratory protection device, comprising:

a facepiece configured to cover at least a mouth and nostrils of a wearer and to allow air for inhalation to enter an inner side of the facepiece in a worn condition when the facepiece is being worn on the wearer;

a voice amplifier including at least a microphone and a speaker;

a detection unit configured to detect, by a direct or indirect method, a change in an inner pressure on the inner side of the facepiece in the worn condition due to inhalation and exhalation of the wearer;

a power source unit; and a control unit electrically connected to the voice amplifier and the detection unit and configured to (i) place the detection unit into an operational state and a non-operational state and (ii) place the voice amplifier into an operational state and a non-operational state based on information transmitted from the detection unit, wherein when the detection unit is in the operational state, the control unit is configured to:

compare a determination reference in the control unit with the information transmitted from the detection unit for at predetermined time intervals, and place the voice amplifier in the operational state or the non-operational state based on a result of the comparison of the information transmitted from the detection unit with the determination reference, when the control unit receives and compares first information, which is a piece of the information transmitted from the detection unit, with the determination reference, the control unit is configured to place the voice amplifier in the operational state, and when the control unit receives and compares second information, that is new information transmitted from the detection unit, with the determination reference, and determines that the voice amplifier is to be placed in the non-operational state, the control unit is configured to continue the operational state of the voice amplifier for a predetermined time period from the determination that the voice amplifier is to be placed in the non-operational state, and release the operational state of the voice amplifier upon a lapse of the predetermined time period.

2. The respiratory protection device according to claim 1, wherein the predetermined time period during which the operational state of the voice amplifier is continued is 0.01 to 2 seconds.

3. The respiratory protection device according to claim 1, wherein each time interval of the predetermined time intervals is 0.01 to 100 msec.

4. The respiratory protection device according to claim 1, wherein the detection unit configured to detect the change in the inner pressure of the facepiece by the indirect method is configured to detect (i) presence or absence of variation and (ii) a variation amount of an open/close valve or a diaphragm attached to the facepiece in response to the change in the inner pressure of the facepiece due to the inhalation and exhalation of the wearer.

5. The respiratory protection device according to claim 4, wherein the variation amount is a variation amount of any of light, ultrasonic waves, magnetism, capacitance, electric currents, voltages, and electric resistance.

6. The respiratory protection device according to claim 4, wherein the presence or absence of the variation is detected as presence or absence of opening or closing of the open/close valve and as presence or absence of variation of the diaphragm.

7. The respiratory protection device according to claim 4, wherein the detection unit includes any of an optical sensor, a magnetic sensor, an ultrasonic sensor, a capacitance sensor, a current sensor, an instrument to measure voltages, and an instrument to measure electric resistance.

8. The respiratory protection device according to claim 4, wherein the determination reference is provided to determine any of an opening degree of the open/close valve, presence or absence of a contact of the open/close valve with a valve seat, the variation amount of the diaphragm, and presence or absence of a contact of the diaphragm with a contact point member with respect to the diaphragm, and wherein in any of (i) when the opening degree is equal to or higher than an opening degree set as the determination reference, (ii) when the open/close valve and the valve seat are not in contact, (iii) when the variation amount of the diaphragm is equal to or higher than a variation amount set as the determination reference, and (iv) when the diaphragm and the contact point member are not in contact, the control unit is configured to place the voice amplifier in the operational state.

9. The respiratory protection device according to claim 4, wherein the voice amplifier is configured to be placed in the operational state in synchronism with a movement of the valve or a movement of the diaphragm in response to the exhalation of the wearer.

10. The respiratory protection device according to claim 1, wherein the detection unit configured to detect the change in the inner pressure of the facepiece by the direct method is a pressure sensor configured to detect the inner pressure of the facepiece.

11. The respiratory protection device according to claim 1, further comprising:

an electric fan that includes a blower unit inclusive of at least a fan and a motor to supply the air for inhalation to the inner side of the facepiece.

12. The respiratory protection device according to claim 11, wherein the power source unit is configured to further operate the blower unit.

13. The respiratory protection device according to claim 11, wherein the detection unit includes any of an optical sensor, a magnetic sensor, an ultrasonic sensor, a capacitance sensor, a current sensor, an instrument to measure voltages, an instrument to measure electric resistance, and a pressure sensor to detect the inner pressure of the facepiece, and any of the optical sensor, the magnetic sensor, the ultrasonic sensor, the capacitance sensor, the current sensor, the instrument to measure voltages, the instrument to measure electric resistance, and the pressure sensor is configured to operate the blower unit.

14. The respiratory protection device according to claim 11, wherein the control unit includes a further determination reference and is configured to control the blower unit based on a result of comparison of the information from the detection unit with the further determination reference.

15. The respiratory protection device according to claim 1, wherein the protection device is any of a dust mask and a gas mask in which the air for inhalation enters the inner side of the facepiece by power of lungs of the wearer who wears the protection device.

16. The respiratory protection device according to claim 1, wherein the protection device is any of a breathing apparatus and an air-supplied respirator in which the air for inhalation enters the inner side of the facepiece from an air supply, which is a separate body with respect to the facepiece.

* * * * *